US009812796B2

(12) United States Patent
Adamczyk et al.

(10) Patent No.: US 9,812,796 B2
(45) Date of Patent: Nov. 7, 2017

(54) TERMINAL BLOCK

(71) Applicant: Weidmüller Interface GmbH & Co. KG, Detmold (DE)

(72) Inventors: Martin Adamczyk, Füssen (DE); Jörn Buhrke, Bünde (DE); Genadij Neumann, Detmold (DE); Andreas Rutz, Bielefeld (DE)

(73) Assignee: Weidmüller Interface GmbH & Co. KG (DE)

( * ) Notice: Subject to any disclaimer, the term of this patent is extended or adjusted under 35 U.S.C. 154(b) by 0 days.

(21) Appl. No.: 15/119,221

(22) PCT Filed: Mar. 25, 2015

(86) PCT No.: PCT/EP2015/056323

§ 371 (c)(1),
(2) Date: Aug. 16, 2016

(87) PCT Pub. No.: WO2015/158505

PCT Pub. Date: Oct. 22, 2015

(65) Prior Publication Data

US 2017/0025771 A1 Jan. 26, 2017

(30) Foreign Application Priority Data

Apr. 14, 2014 (DE) ..... 10 2014 105 316

(51) Int. Cl.
*H01R 9/26* (2006.01)
*H01R 11/07* (2006.01)

(52) U.S. Cl.
CPC ..... *H01R 9/2675* (2013.01); *H01R 9/2683* (2013.01); *H01R 9/2691* (2013.01); *H01R 11/07* (2013.01)

(58) Field of Classification Search
CPC .. H01R 9/2458; H01R 9/2475; H01R 9/2675; H01R 9/2483; H01R 9/2691;
(Continued)

(56) References Cited

U.S. PATENT DOCUMENTS 4,795,376 A * 1/1989 Franke ..... H01R 9/26 439/715
5,669,788 A * 9/1997 Brockman ..... H01R 9/2675 439/511

(Continued)

FOREIGN PATENT DOCUMENTS

DE 4438800 C1 1/1996
DE 29719177 U1 12/1997

(Continued)

*Primary Examiner* — Gary Paumen
(74) *Attorney, Agent, or Firm* — Laubscher, Spendlove & Laubscher, P.C.

(57) ABSTRACT

A terminal block assembly is provided, comprising a plurality of terminal blocks mounted on a common horizontal support member, including a supply terminal block connected with a voltage source, and a plurality of distribution terminal blocks connected with a plurality of loads, respectively, characterized in that the length and height dimensions of the terminal blocks are the same, but the width of the supply terminal block is greater than that of the distribution terminal blocks, and that the supply conductor contact arrangements of the supply terminal block are designed for connection with a supply conductor having a relatively large cross-sectional area, while the distribution conductor contact arrangements of the distribution terminal blocks are designed for connection with distribution conductors having a relatively small cross-sectional area. A conductive comb member extends transversely across the assembly to interconnect the electrical circuitry contained within the terminal block housings.

19 Claims, 6 Drawing Sheets

(58) Field of Classification Search
CPC ..... H01R 9/2608; H01R 9/26; H01R 31/08; H01R 31/085
USPC ..... 439/717, 716, 507–514
See application file for complete search history.

(56) References Cited

U.S. PATENT DOCUMENTS

| | | | | |
|---|---|---|---|---|
| 5,722,862 | A * | 3/1998 | Glathe | H01R 9/2658 439/511 |
| 6,848,951 | B1 * | 2/2005 | Bechaz | H01R 9/2491 439/716 |
| 7,234,961 | B2 * | 6/2007 | Arlitt | H01R 4/24 439/212 |
| 7,438,604 | B2 * | 10/2008 | Andresen | H01R 4/4818 439/709 |
| 7,862,389 | B2 * | 1/2011 | Pizzi | H01R 4/28 439/709 |
| 8,133,081 | B2 * | 3/2012 | Braunlich | H01R 9/2625 439/488 |
| 8,517,758 | B2 * | 8/2013 | Pizzi | H01R 9/2683 439/491 |
| 8,851,920 | B2 * | 10/2014 | Wu | H01R 4/4827 439/441 |

FOREIGN PATENT DOCUMENTS

| | | | |
|---|---|---|---|
| EP | 0222030 | A1 | 11/1985 |
| FR | 2723265 | A1 | 2/1996 |
| FR | 2803441 | A1 | 7/2001 |
| FR | 2901418 | A1 | 11/2007 |
| WO | 2012018371 | A1 | 9/2012 |

* cited by examiner

TERMINAL BLOCK

REFERENCE TO RELATED APPLICATIONS

This application is a national stage application under 35 U.S.C. §371 of the PCT International Application No. PCT/EP2015/056323 filed Mar. 25, 2015, which claims priority of the German application No. DE 10 2014 105 316.8 filed Apr. 14, 2014.

BACKGROUND OF THE INVENTION

Field of the Invention

An assembly of a plurality of terminal blocks mounted on a common horizontal support member is provided, including a supply terminal block connected with a voltage source, and a plurality of distribution terminal blocks connected with a plurality of loads, respectively, characterized in that the length and height dimensions of the terminal blocks are the same, but the width of the supply terminal block is greater than that of the distribution terminal blocks, and that the supply conductor contact arrangements of the supply terminal block are designed for connection with a supply conductor having a relatively large cross-sectional area, while the distribution conductor contact arrangements of the distribution terminal blocks are designed for connection with distribution conductors having a relatively small cross-sectional area.

Description of Related Art

Modular terminal blocks have long been known in the most diverse of configurations. They are assembled on the mounting base, generally a hat-shaped support rail, into functional blocks, such as a functional block for the power supply of consumers. For this, according to the prior art, several output terminals are placed in a row on a modular terminal block, serving as a feed-in terminal, wherein the potential distribution within the terminal block occurs by means of bus bars or by means of so-called cross links.

In order to realize an installation task—for example, the providing of a voltage distribution between an inverter power supply and consumers—with or without a secured Plus potential—the user assembles several terminal blocks into a terminal block assembly. For example, in order to assemble the afore-mentioned terminal block for the power supply of consumers (hereinafter also called operating means), a feed-in terminal with a housing with relatively large dimensions in the directions normal to the support rail and at least one larger conductor connection arrangement or a conductor connection for conductors of relatively large diameter are placed in a row with several modular terminals suitable for an output function, for example by means of modular through terminals each having a housing of smaller dimensions in these directions and with two or more smaller conductor connection apparatuses for reduced cross-section conductors (compared to the feed-in conductor(s)) of smaller diameter.

The modular terminal blocks of the terminal block assembly, however, generally have sometimes different dimensions. The selection and assembly of the modular terminal blocks—and also the realization of a corresponding circuit with the modular terminal blocks—must be accomplished by the user himself with the aid of catalogs and the like, which can be relatively laborious. Furthermore, on account of the different dimensions of the housings being assembled into a block on the support rail, a relatively unsightly, jagged appearance often results.

A further terminal block and a further modular terminal block arrangement of the prior art is shown by EP 0 222 030 B1. According to this document, several modular terminals of the same dimension are assembled into an initiator terminal block. However, the terminal block is only suitable for the distribution of very small powers. No reduction of the cross section is accomplished.

On the other hand, the present invention takes a different approach, wherein the supply and distribution terminal blocks have the same length and height dimensions, but the width of the supply terminal block is greater than that on the distribution terminal blocks, thereby to permit the contact connections to the relatively-large-diameter supply conductor to be larger than the contact connections to the relatively-small-diameter distribution conductors.

SUMMARY OF THE INVENTION

Accordingly, a primary object of the invention is to provide a terminal block assembly including a plurality of terminal blocks mounted on a common horizontal support member is provided, including a supply terminal block connected with a voltage source, and a plurality of distribution terminal blocks connected with a plurality of loads, respectively, characterized in that the length and height dimensions of the terminal blocks are the same, but the width of the supply terminal block is greater than that of the distribution terminal blocks, and that the supply conductor contact arrangements of the supply terminal block are designed for connection with a supply conductor having a relatively large cross-sectional area, while the distribution conductor contact arrangements of the distribution terminal blocks are designed for connection with distribution conductors having a relatively small cross-sectional area. A conductive comb member extends transversely across the assembly to interconnect the electrical circuitry contained within the terminal block housings.

According to a more specific object of the invention, the terminal blocks include rectangular housings having coplanar horizontal top walls and contiguous vertical side walls, with the top wall of the supply terminal block containing one or more openings of relatively large size for connection with a relatively large-diameter supply conductor, and the top walls of the distribution terminal block housings containing smaller openings for connection with relatively small-diameter distribution conductors. In one embodiment of the invention, the supply terminal block housing top wall contains two openings for connection with two supply conductors, while in another embodiment, the supply terminal block housing top wall contains a single relatively large supply conductor opening for connection with a single supply conductor, together with a plurality of smaller distribution conductor openings for connection with distribution conductors.

BRIEF DESCRIPTION OF THE DRAWINGS

Other objects and advantages of the invention will become apparent from a study of the following specification, when viewed in the light of the accompanying drawing, in which.

DETAILED DESCRIPTION OF THE INVENTION

Figure 1A:
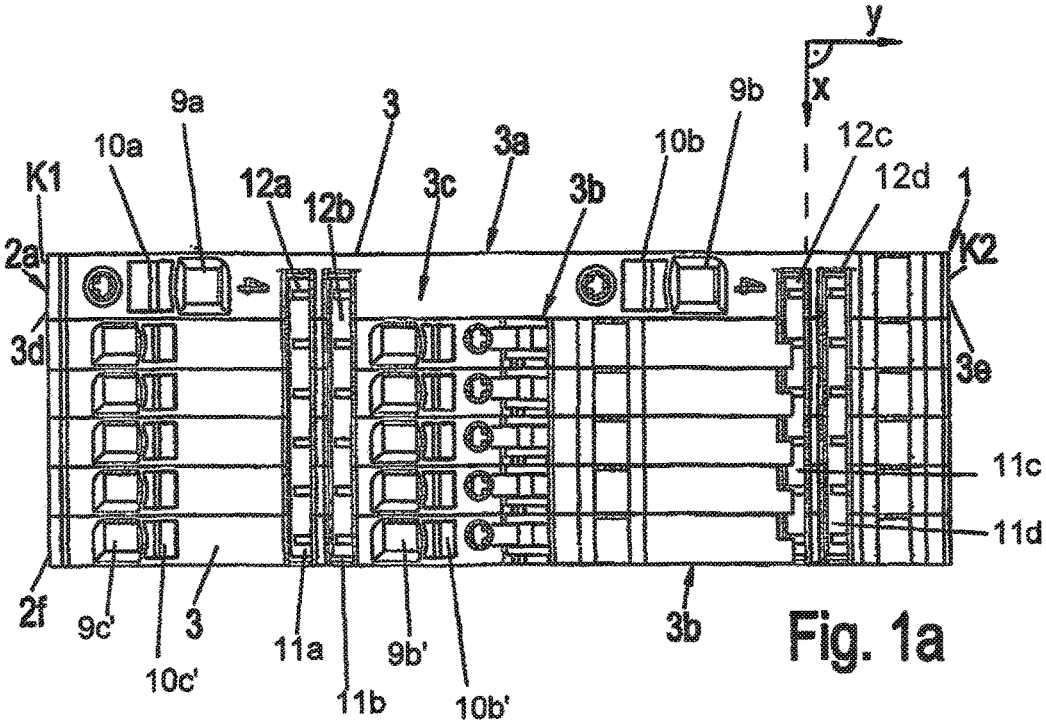
FIG. 1*a* is a top plan view of a first embodiment of the terminal block assembly of the present invention.
Figure 1B:
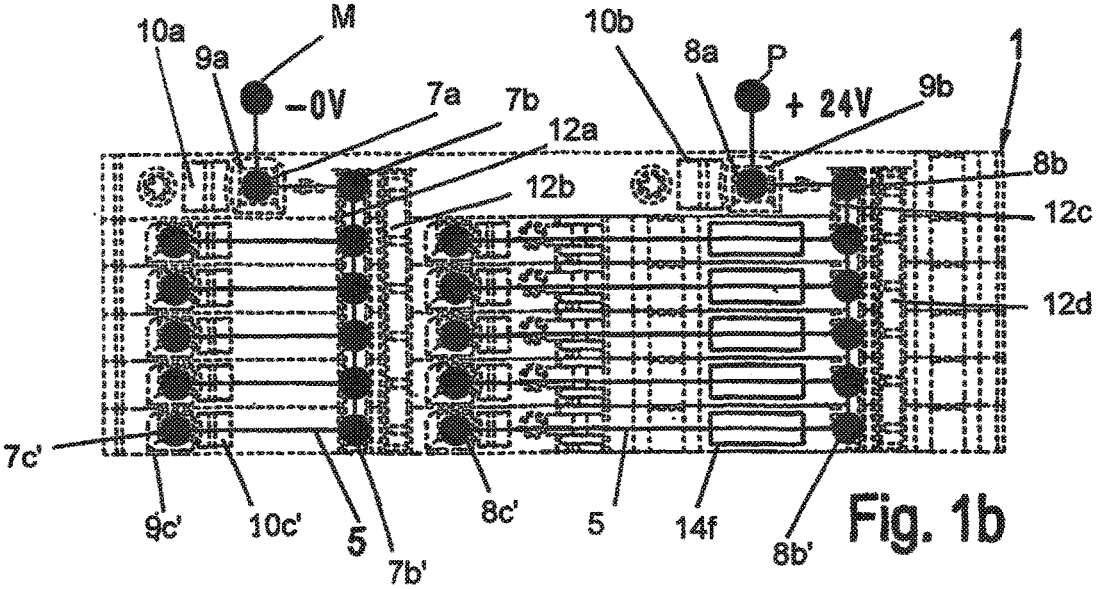
FIG. 1*b* is a schematic representation of the electrical circuitry of the apparatus of FIG. 1*a;*
Figure 1C:
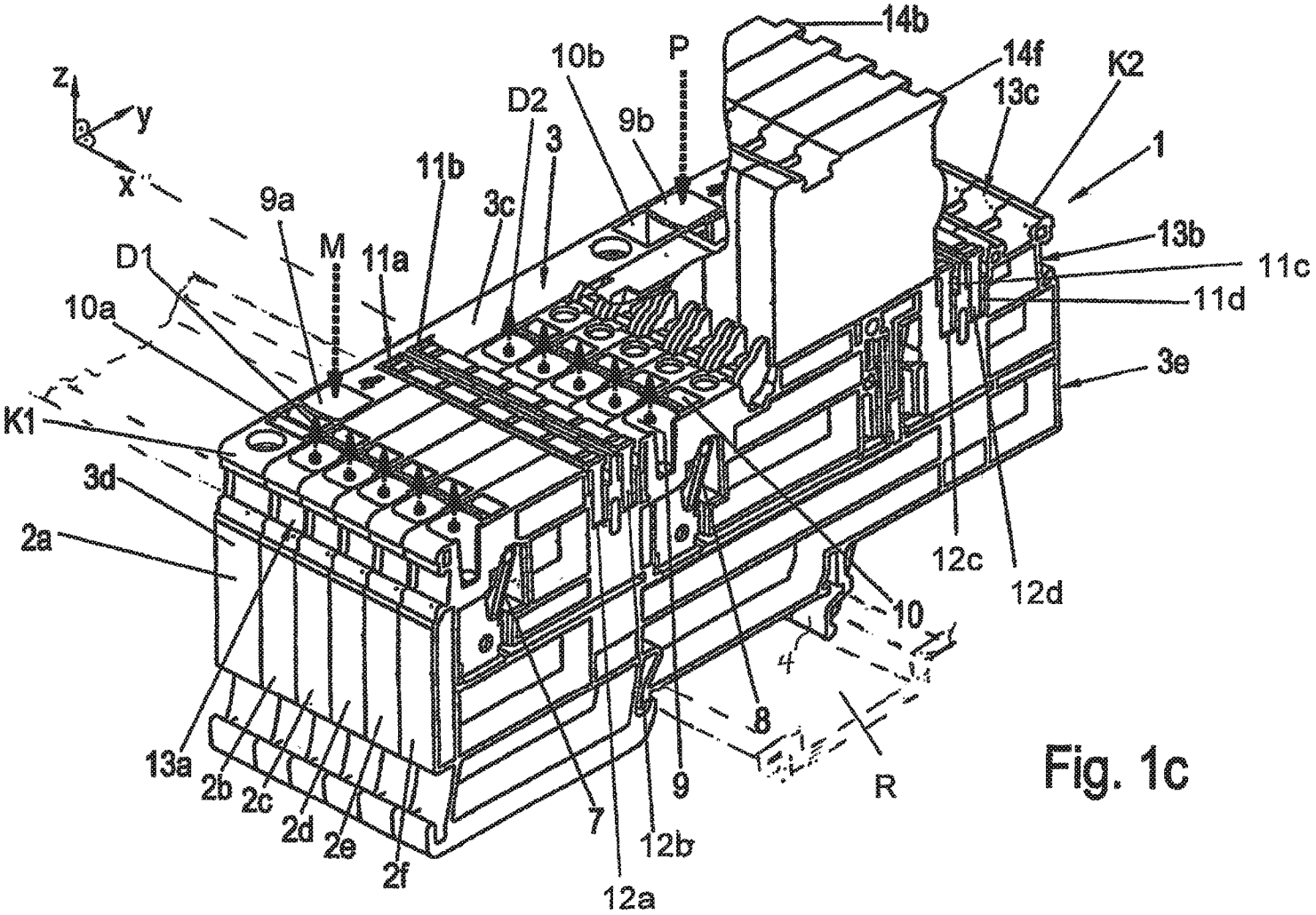
FIG. 1*c* is a front perspective view of the apparatus of FIG. 1*a;*

Briefly, referring first more particularly to FIGS. 1*a* and 1*c*, the terminal block assembly 1 includes a supply terminal block 2*a* and a plurality of distribution terminal blocks 2*b*-2*f*, mounted in side-to-side relation on a conventional hat-shaped horizontal support rail R. The terminal blocks include rectangular housings 3 having vertical parallel spaced side walls 3*a*, 3*b*, a horizontal top wall 3*c*, and a pair of vertical end walls 3*d*, 3*e*. The bottom portion of each terminal block is provided with mounting feet 4 for mounting the terminal blocks on the support rail. In accordance with a characterizing feature of the invention, the length and height dimensions (y and z directions in FIG. 1*c*) of all of the terminal blocks are the same, but the width of the supply terminal block 2*a* (x direction in FIG. 1*c*) is greater than that of the distribution terminal blocks.

Adjacent a first upper corner K1 of the assembly, the top wall 3*c* of the supply terminal block 2*a* contains a first relatively large opening 9*a* for receiving a relatively large-diameter Minus voltage conductor M. Adjacent the other top corner, the supply terminal block top wall contains a second opening 9*b* for receiving the relatively large-diameter Plus voltage supply conductor P. Push buttons arranged in activation openings 10*a* and 10*b* serve to open resilient contacts 7 and 8 arranged below the openings for the insertion and removal of the large-diameter voltage supply conductors.

Similarly, the top walls 3*c* of the distribution terminal blocks 2*b*-2*f* contain openings 9*b*' and 9*c*' for receiving relatively small-diameter distribution conductors D1 and D2, respectively. Activation openings 10*b*' and 10*c*' are adapted to receive activating devices—such a push buttons, the tips of screwdrivers, or the like—which open the associated spring contacts 7 and 8 arranged below these openings, respectively, thereby to permit insertion and removal of the distribution conductors.

In order to electrically interconnect the terminal blocks, the top portion of the terminal block assembly contains transverse grooves 11*a*-11*d* that receive conductive cross-connecting comb members 12*a*-12*d*, respectively. A plurality of fuse devices 14*b*-14*c* are mounted on the distribution terminal blocks adjacent the second top corner K2.

As shown by the wiring diagram of FIG. 1*b*, the relatively large cross-section supply conductor M (that is at a minus [or zero] direct-current potential) is inserted in the opening 9*a* in the supply terminal block 2*a* for connection with input contact 7*a*, which contact is connected by bus bar 5 with the comb contact 7*b*, which comb contact is connected by conductive comb member 12*a* to the corresponding comb contacts 7*b*' in the distribution blocks 2*b*-2*f*. These comb contacts are connected by bus bars 5 with the contacts 7*c*' which are connected with the first set of smaller cross-section first distribution conductors D1 (FIG. 1*c*).

Similarly, the relatively large cross-section positive supply conductor P (having here a potential of +24 volts) is connected with input contact 8*a*, and then by a bus bar to comb contact 8*b*. This comb contact is connected by conductive comb member 12*c* with comb contacts 8*b*' of the distribution terminal blocks 2*b*-2*f*, which comb contacts are connected with output contacts 8*c*' via fuse devices 14*b*-14*f* and corresponding bus bars. These output contacts are connected with the second set of smaller-cross-section second distribution conductors D2 (FIG. 1*c*), respectively, that supply power to the consumers.

More particularly, FIG. 1 shows a first terminal block assembly which consists of at least two or more—here, for example, six—modular terminal blocks 2*a*-2*f* arranged in a row in one direction of modular arrangement x. The modular terminal blocks 2*a*-2*f* each have a rectangular housing 3 made of an insulator, especially an insulating synthetic plastic material.

One or more or preferably each of the housings 3 of the terminal block assembly 1 has, at its lower side facing a support rail R a fastening foot 4, such as a locking foot, for mounting on the support rail. The housings 3 of the modular terminal blocks 2*a*-2*f* of the terminal block assembly each have the same dimensions perpendicular to the direction of modular arrangement (in the directions "y", i.e., transverse to the direction of modular arrangement x and transverse to the main direction of extension of the support rail, and "z", i.e., perpendicular to the direction of modular arrangement x and relatively upward to a support rail). Only in the direction of modular arrangement x is the first modular terminal block 2*a* here broader than the other modular terminal blocks 2*b*-2*f*. In the direction of modular arrangement x, the housings 3 have their (largest) main sides 3*a*, 3*b* arranged in a row (except for the very outside in the block). In the z-direction or parallel to the x/z-plane, they have narrow sides 3*d*, 3*e*. The narrow sides 3*d*, 3*e* border on the top side 3*c* of the housing 3 in two corner regions K1 and K2.

Preferably, the modular terminal blocks 2*a*, 2*b*, 2*c*, . . . of the terminal block assembly 1 are joined together, for example, by corresponding clamping or locking pins (not seen here) on their outer sides adjoining each other and extending perpendicular to the direction of modular arrangement.

In the interior of the housing 3 of each modular terminal 2*a*-2*f* there is provided at least one or (here) preferably two conductor connection arrangements 7, 8 (see the modular terminal block 2*f* in FIG. 1*c*) for the connection of electrical conductors. Preferably, the conductor connection arrangements 7, 8 are designed as so-called push-in spring terminals with a compression spring connection, which has a compression spring that serves to press the inserted conductor in conducting manner against a current bus bar (not seen here). The use of push-in spring terminals is especially preferred, since their handling is especially simple, secure, and rapid. But other conductor connection apparatuses such as tension spring connections, IDC connections, or screw connections can also be used.

For each of the conductor connection apparatuses 7, 8 there is a conductor insert opening 9 and preferably also an activation opening 10 formed in the housing, where each bare end stripped of insulation of the conductor or the like can be introduced through the conductor insert openings 9 into a contact region, especially a clamping contact region, in the corresponding conductor connection apparatus 7, 8. The optional activation opening 10, on the other hand, serves to accommodate an operating element—such as a push button arranged in the housing and activated by a screw driver, or the tip of a screw driver—in the housing in order to open the spring or the conductor connection apparatus, so that an inserted conductor can be removed once more or be inserted.

All of the conductor insert openings 9 and the optionally present activation openings 10 are formed on the narrow top side 3*c*—i.e., on the side of the housing 3 of the modular terminal block 2 facing away from the fastening foot 4. This makes the terminal block 1 especially clearly laid out and its handling especially simple—especially the wiring with conductors and the connecting to form an upper-level system.

More particularly, each of the conductor connection arrangements 7-8 (in FIG. 1 *b* represented as a dark spot and in FIG. 1*c* indicated by arrow) is moreover led across a conductor connection, such as a bus bar 5 (not recognizable here but indicated schematically in FIG. 1 *b*) inside the housing (or another suitable conductor) into or beneath the region of at least one cross connection link channel 11 in the housing 3. Here, two cross connection link channels 11*a*, 11*b* are provided for each conductor connection apparatus 7,8.

The cross connection link channel(s) 11*a*, 11*b* serve each time for the inserting of a cross-connection link conductive comb member 12*a*, 12*b*, for the distribution of a potential in the direction of modular arrangement x of the terminal block 1 across two or more of the modular terminal blocks 2*a*-2*f*. For this, the respective current bus bars can be provided with holes in the corresponding regions beneath or at the bottom of the cross connection link channels 11*a, b*, in which pins or fingers of the cross connection link comb can be inserted (not evident here). Preferably and advantageously, two of the cross connection link combs 12*a*, 12*b* are provided for each conductor connection apparatus and current bus bar in order to cross distribute a corresponding potential "+" or "–" or "P" or "M" each time.

Thus, on the whole, each of the modular terminal blocks 2*a*-2*f* preferably has four cross connection link channels 11*a*-11*d* and optionally four pluggable and preferably also plugged-in cross links, especially cross connection link combs 12*a*-12*d*. On the two narrow end walls 3*d*, 3*e* of the housing 3 extending in the y direction perpendicular to the longitudinal direction x—here, as far as the upper edge—there are advantageously provided contours 13*a*, 13*b* in the upper region for the placement of markers (not shown here), preferably by snapping on.

Figures 1D, 1E, 1F, 1G:
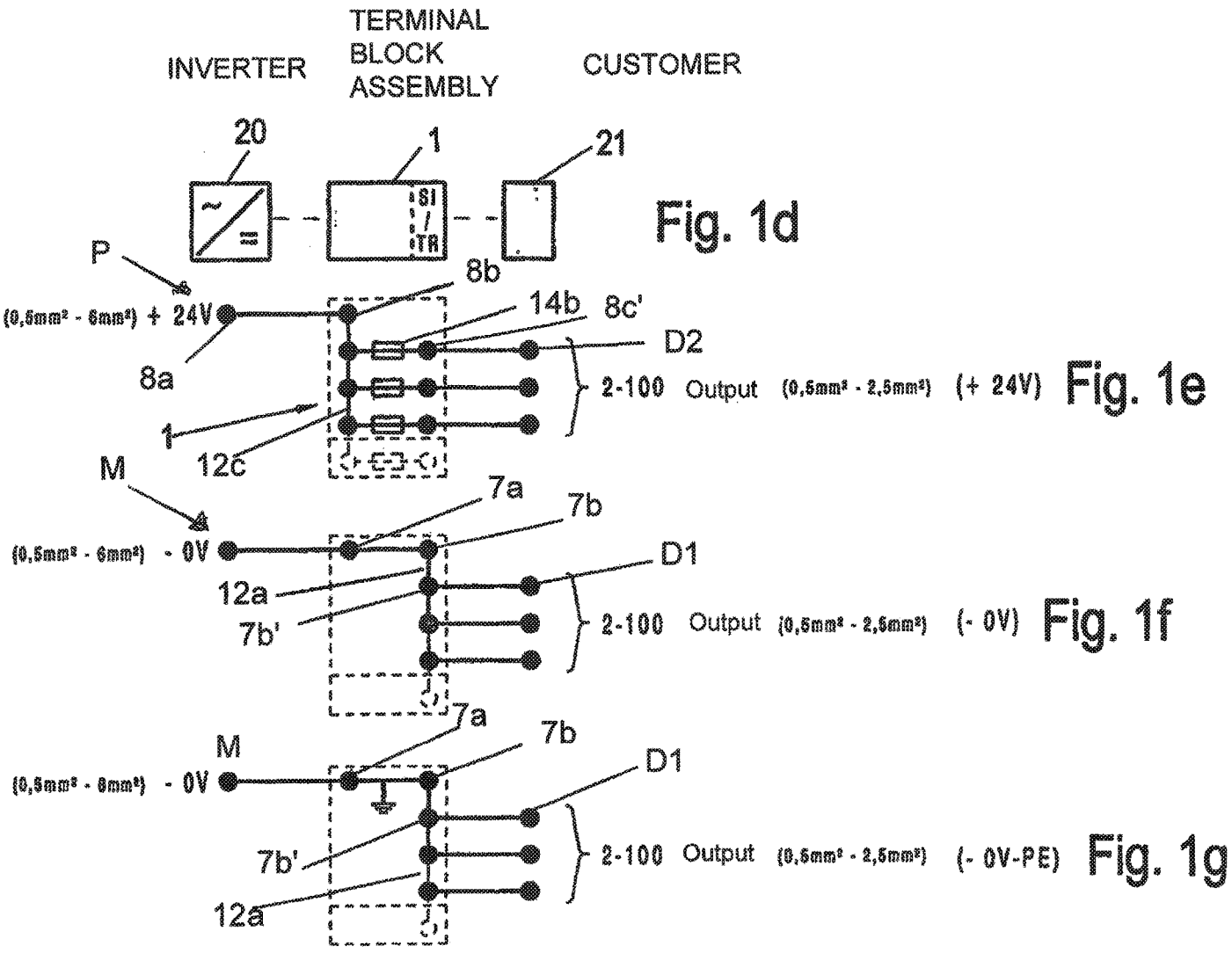
FIG. 1*d* is a block diagram of an electrical distribution system using the apparatus of FIG. 1*a;*
FIG. 1*e* is a circuit diagram of the Plus voltage distribution portion of the apparatus of FIG. 1.
FIG. 1*f* is a circuit diagram of the Minus voltage distribution portion of the apparatus of FIG. 1*a;*
FIG. 1*g* is a modification of the circuit of FIG. 1*f;*

The first modular terminal block 2*a* of the terminal block assembly 1 for the power distribution according to FIG. 1*e* is designed as an input terminal block. The housing 3 of this first modular terminal block 2*a* has a greater width in the direction of modular arrangement than the other housings 3. This first modular terminal 2*a* forms, preferably at one side, the exposed end of the terminal block assembly, which makes the terminal block assembly 1 clean in its layout. But it would also be conceivable to arrange this feed-in terminal block 2*a* in another place in the terminal block assembly 1. Preferably, the free outer side 3*a* of the first modular supply terminal block 2*a* or feed-in terminal is closed and facing away from the next adjacent modular terminal block 2*b*.

On the side facing away from the fastening foot, each housing 3 has two of the conductor insert openings 9. One of the conductor insert openings 9 is arranged relative to one edge K1 on the top side 3*c* of the respective modular terminal and the other of the conductor insert openings is arranged on the top side 3*c*, starting from this edge K1 on the section between K1 and K2 in a region between around 60 and 90% of the length of the section between K1 and K2.

Starting from the edge K1, there are formed on the top side, here behind the first and the second conductor insert opening 9, preferably every one or preferably every two of the cross connection link channels 11*a*, 11*b*, which in turn end preferably at the middle of the first modular terminal block 2*a*, configured as a feed-in terminal, in the direction of modular arrangement x in the housing 3, which is preferable but not mandatory.

The other terminal blocks 2*b*-2*f* lined up next to the feed-in terminal 2*a* have a somewhat different construction. These other modular terminal blocks 2*b*-2*f* serve for the connecting of preferably one of the consumers to each of the other modular terminals 2*b*-2*f*, also known as distribution board terminals.

The top sides 3*c* of these distribution board terminals 2*b*-2*f* have the following construction. Each time adjacent to one edge K1 is the conductor insert opening 9 of the first conductor connection apparatus, then the activation opening 10, preferably with push button, and then the one or the two or more of the cross connection link channels 11*a*, 11*b* associated with the first conductor connection apparatus, in which a cross-connection link comb 12*a, b* can be inserted in turn.

Then there follows, in the direction of the second edge K2, at first the insert opening 9 of the second conductor connection apparatus, then its activation opening 10, preferably with a push button, then a fuse housing 14*b*-14*f* with fuse and plug-in contacts for making contact with a bus bar in the housing 3, and then the cross connection link channel (s) 11*a*, 11*b* of the second conductor connection apparatuses. Between the second cross connection link channels 11*a*, 11*b* and the second edge K2 there is then preferably arranged yet another contour 13*c* for the placement of a third marker.

The first conductor connection arrangement and the first conductor connection of the feed-in terminal block 2*a* lies roughly flush with the other first conductor connection apparatuses or conductor connection apparatuses 7 of the lined-up distribution board or output terminal blocks 2*b*-2*f*.

The second conductor connection arrangements of the modular terminal blocks 2*b*-2*f* (which can also be called distribution board or output terminals 2*b*-2*f*) serve preferably to connect conductors with at most a somewhat smaller cross section than is allowed by the first conductor connection arrangements of the feed-in terminal block 2*a*. Thus, there is a reduction in the cross-section of the conductor from the feed-in terminal 2*a* to the distribution board terminal blocks 2*b*-2*f*. The cross connection link channels 11 and the cross connection link combs 12 for the cross distribution of the first potential (preferably "Plus"; this potential is distributed in the representation of FIG. 1*c* in the left region of the terminal or to the edge K1) lie at the side of these first conductor connection apparatuses and are conductively connected to them.

In this way, the functional region for the feeding in and the cross-distributing and realizing of the first potential (Minus) of the output connections takes up less than half, preferably around a third, of the top side 3*c* of the housing 3 of the modular terminals 2. The rest, preferably the remaining two thirds of the top side 3*c* of the housing 3 of the modular terminal assembly serves for arranging the other conductor insert openings 9 for the conductor connection apparatuses for the connecting of conductors to relay the Plus potential, for the placement of the respective fuse housing 14*b*-14*f*, for the arranging of one or two additional cross-connection link channels 11 for cross links comb members 12 and for the forming of the additional mounting contour 13*c* for the placement of a third marker.

In this way, the second potential (Plus) is cross-distributed from the feed-in terminal 2*a*, distributed across current bus bars and plug-in devices into the fuse housing with the fuses, and from here across the fuses and contacts on the fuse housing 14 back to bus bar pieces which are connected to the second conductor connection apparatuses of the modular terminal blocks 2*b*-2*f* lined up next to the feed-in terminal. In this way, a fuse is hooked up each time between the input for the feeding of the second potential and the further outputs (conductor connection contacts 8).

The terminal block assembly 1 of FIG. 1*c* thus, with only a few modular terminals, realizes preferably the function "(auxiliary) power distribution with single fuse of FIG. 1*e*. The feeding of the Plus (+24 volt) and Minus (−0 volt) potentials at the feed-in terminal block 2*a* is done with a larger cross section, which is preferably from 0.5 $mm^2$ up to 6 $mm^2$ (which is generally enough for a 40 ampere power supply in terms of current). This becomes possible for only a few modular terminals, since the arrangement of the functional regions on the top sides of the modular terminals is clearly laid out and in particular optimized in terms of function.

Thus, with the terminal block assembly of FIG. 1*c*, the auxiliary power distribution with a protection of the Plus potential by a fuse is realized in especially simple and clearly laid out manner. The Plus and Minus potentials are fed in at the feed-in terminal block 2*a* and relayed each time with reduction in cross section at the individual distribution board terminal blocks 2*b*-2*f* to the operating means or consumers (see FIG. 1*a*-1*e*). The Plus potential has a single fuse protection at the output side. The Minus potential is fed in, reduced in cross section, and relayed directly to the individual operating means. Alternatively, it can also be connected to the support rail across a PE foot or be grounded, which can be used as a functional ground or as a PE potential. The distribution conductors have a cross-section of from about 0.5 $mm^2$ to about 2.5 $mm^2$.

It is advantageous that two potentials are distributed in simple and especially clearly laid out manner for each distribution board terminal with integrated fuse function. This results in a design with only a few terminals as compared to the known design, in which the potential carried across a fuse is distributed across one terminal and the other respective potential across another terminal.

It is also advantageous that the outputs or conductor connection apparatuses of the distribution board terminals lie on the top side 3*c* with the fuse housing 14 placed thereon, since this makes the circuitry or the connection situation especially logical and clearly visible on the respective housing 3. The number of distribution board terminal blocks 2*b*-2*e* here is only an example. It is also possible to provide for each feed-in terminal block only one or also several of the many more (preferably up to 100) distribution terminal blocks.

FIGS. 1*f* and 1*g* show circuits for an analogous auxiliary power supply distribution, yet in which the Plus potential is not protected by a single fuse. Therefore, the second conductor connection apparatuses of the distribution board terminals can be directly connected here to their cross-connection link channels without a fuse being included in the conductor pathway. Thus, this function can also be realized with a terminal block according to FIG. 1*c* but one without a fuse housing and fuse and with a continuous bus bar in this region (not represented).

In one or in each of the modular terminals of the terminal block in FIG. 1*c* (or also FIG. 2*c*, as will be explained below), the Minus potential can be connected conductively to the support rail across a conductive contact at the foot of the support rail, in order to connect the Minus potential to a ground potential, such as a functional ground FE or to a potential PE.

It should further be noted that, in the terminal block assembly 1 in FIG. 1*c* (and also the terminal block assembly 101 in FIG. 2*c*), all the conductor insert openings 9 and their corresponding activation openings 10 in the feed-in terminal and reaching through into the distribution board terminals 2*b*-2*f* are arranged each time in the same direction or relative to one of the corners K1 for each of the conductor connection apparatuses in the same series (in the y-direction), which helps make the overall terminal block assembly 1 especially cleanly laid out. Thus, in the feed-in terminal block 2*a*, the activation openings 10 with push buttons lie relative to the corner K1 on the side of the conductor insert openings 9 facing this corner K1, while the opposite is the case in the distribution board terminal blocks 2*b*-2*f*. On the other hand, if standard through terminals are used for the distribution, the conductor insert openings there are arranged generally on both sides of a mid-plane perpendicular to the middle of the support rail (x/y plane) in opposite directions. But it is more clear and logical to select a same-direction arrangement for the same function (i.e., input potential, distributing potential).

FIG. 2 shows another terminal block assembly 101, which is used for auxiliary power supply distribution without fuse protection. It should be noted that here as well all conductor insert openings 9 and their corresponding activation openings 10 preferably with push buttons for the distribution (output) are arranged in the same direction in the same series with regard to one of the corners K1 of the housing 103 on the top sides 103*c* (in the y-direction transverse to the direction of modular arrangement x), which helps make the overall terminal block assembly 1 especially cleanly laid out. Only the conductor insert opening 9*a* and the activation opening 10*a* with push button for feed-in (indicated in FIG. 2*c* by an arrow pointing into the housing 103) are somewhat rearranged in order to illustrate the functional difference (feeding in, distributing).

Advantageously, only a single potential is distributed for each terminal block assembly 101. Therefore, in order to hook up or distribute Plus and Minus voltage power to consumers, two modular terminal blocks of the same or largely the same design are needed (FIGS. 2*d*, 2*e*).

Figure 2A:
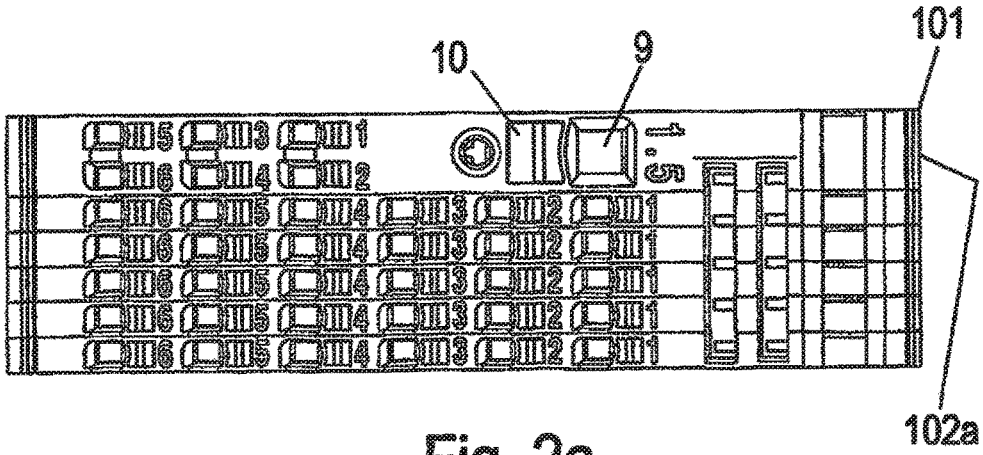
FIG. 2*a* is a top plan view of a second embodiment of the terminal block assembly of the present invention.
Figure 2B:
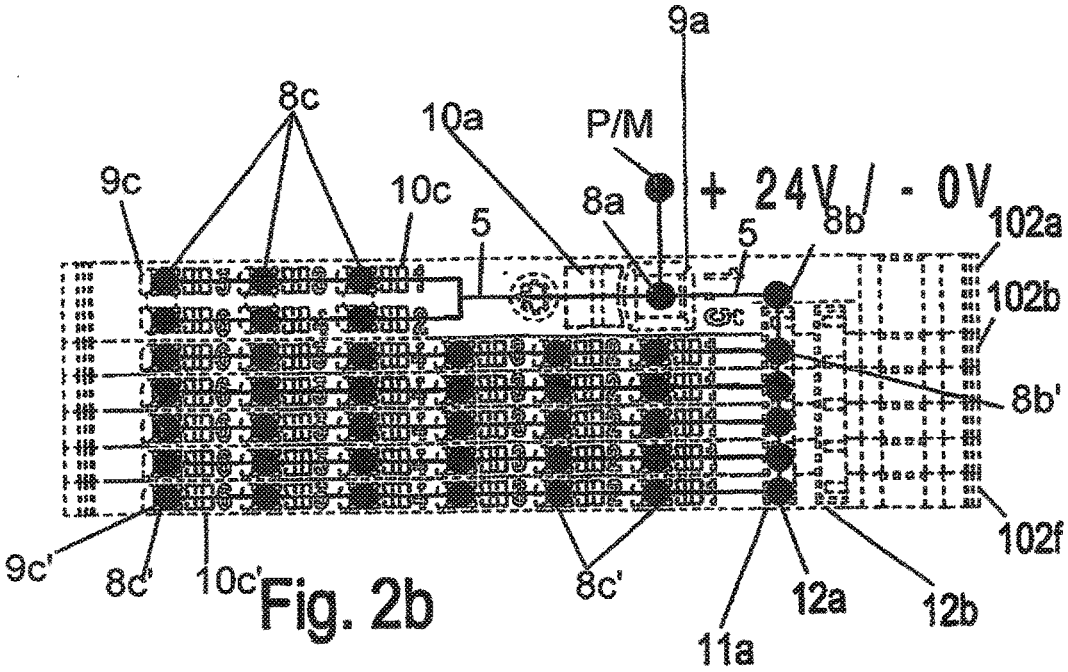
FIG. 2*b* is a schematic representation of the electrical circuitry of the apparatus of FIG. 2*a;*
Figure 2C:
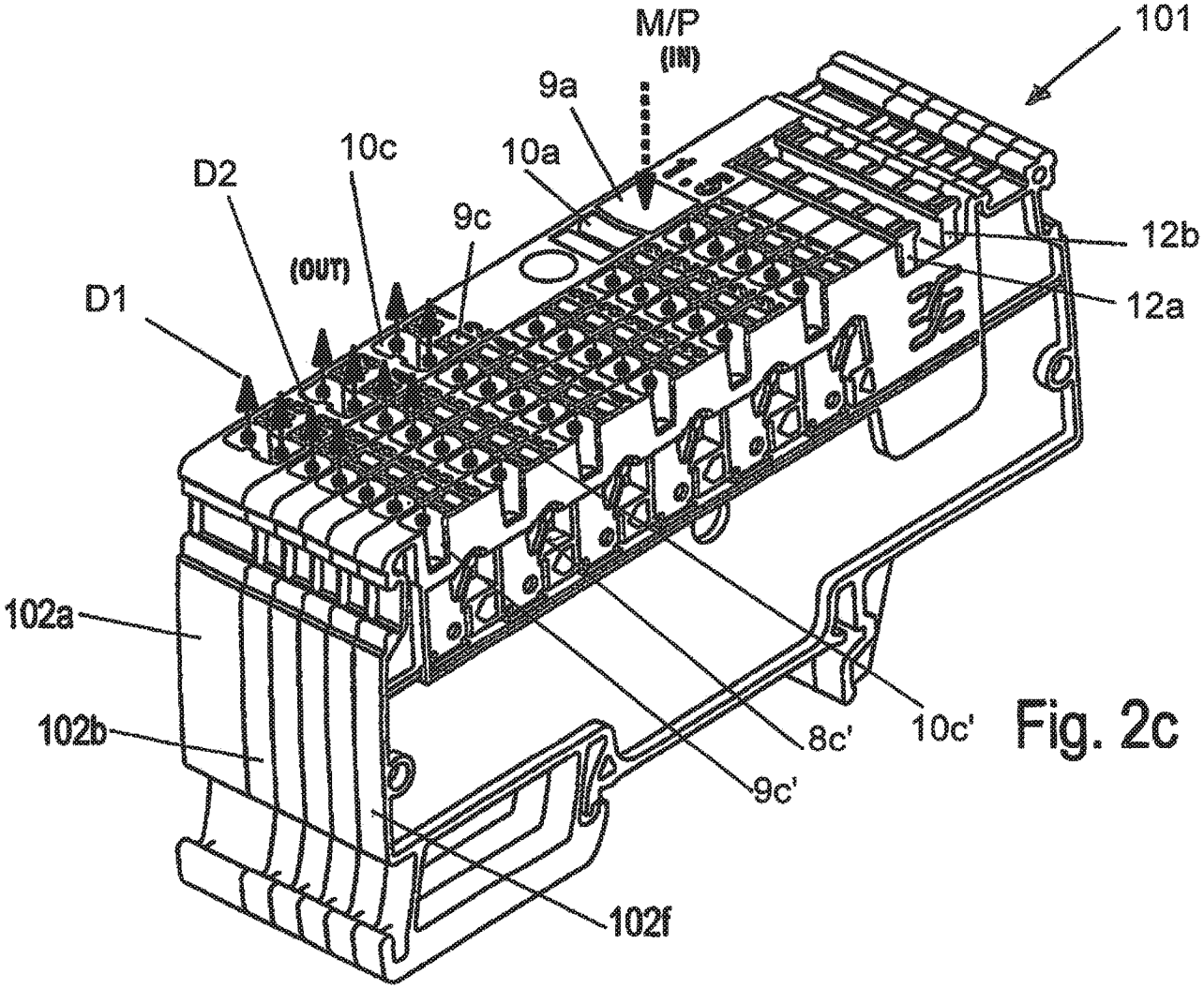
FIG. 2*c* is a front perspective view of the apparatus of FIG. 2*a;*
Figures 2D, 2E, 2F:
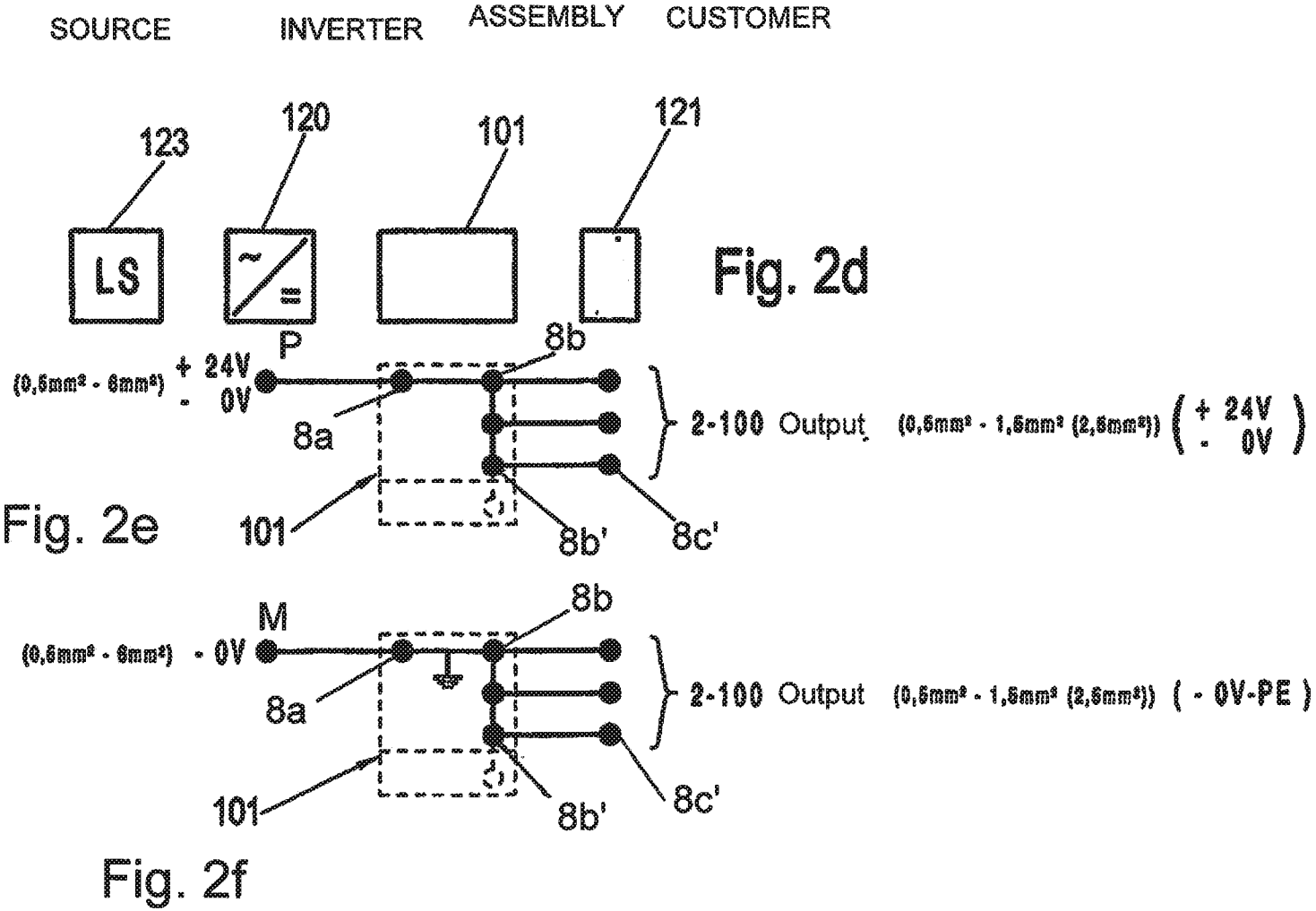
FIG. 2*d* is a block diagram of an electrical distribution system using the apparatus of FIG. 2*a;*
FIG. 2*e* is a circuit diagram of the Plus voltage distribution portion of the apparatus of FIG. 2*a; and*
FIG. 2*f* is a circuit diagram of the Minus voltage distribution portion of the apparatus of FIG. 2*a*.

Briefly, as shown in FIGS. 2*b* and 2*c*, the input large-diameter supply conductor—P (+24 volt) or M (−0 volt)—supplies power to input contact 8*a* of the supply terminal block 102*a*, which contact is connected by bus bar 5 with six small-diameter distributor contact arrangements 8*c*, 9*c*, 10*c* that are connected with a first set of small-diameter distribution conductors D1 (FIG. 2*c*), respectively, that supply power to the consumers. This input contact 8*a* is also connected by a bus bar 5 with contact 8*b* that is connected by conductive comb member 12*a* with corresponding contacts 8*b*' on a plurality of distribution terminal blocks 102*b*-102*f*. These contacts 8*b*' are connected by bus bars 5 with small-diameter contact arrangements 8*c*', 9*c*', 10*c*' that are connected with a second set of small-diameter distribution conductors D2 (FIG. 2*c*) that also distribute power to the consumers.

More particularly, a supply terminal block 102*a* once again serves to apply or feed in the potential. This has a first conductor connection of larger cross section 8*a*, 9*a*, 10*a*, which serves to connect the potential P/M being fed in or distributed. For this, the first conductor connection is designed for the connecting of conductors of larger cross section (such as 0.5 $mm^2$ to 6 $mm^2$). Already with the first modular terminal or this feed-in terminal block, the potential is taken with cross-section reduction to several second conductor connection arrangements (outputs). The first conductor connection here is arranged along with two cross-connection link channels 11*a* in a first half of the top side 3*c*, while the second conductor connection apparatuses or their conductor insert openings 10 are distributed in the second half of the top side 3*c* of the supply terminal block 102*a*. In the supply terminal block 102*a*, there are provided in the one half of the top side 3*c* two rows of one, two, or preferably three or even more of the second conductor insert openings or conductor connection apparatuses, so that already in the feed-in terminal 102*a* six distributor conductor connection arrangements D1 are also formed as outputs along with their openings 9 and 10 on or in the top side 3*c*. Thus, from the pure supply terminal block, a combined supply and distribution board terminal block 102*a* is produced.

On the housing 3 at the top side of each modular terminal block 102*a*-102*f* of the terminal block assembly 101, once again one or two or more of the cross connection link channels 11*a*, 11*b* are formed. The other modular terminals 102*b*-102*f* are configured as pure distribution board terminal blocks. Finally, the contours 13*a*-13*c* of the housing 3 correspond to those of the housing of FIG. 1. That is, wherein a contour 13*c* is also formed for the placement of a marker between the cross connection link channels 12*a*, 12*b* and the corner K2.

By means of the one or by means of two or more cross connection link combs 12*a*-12*b*, the supply potential is cross distributed from the supply/distribution terminal block 102*a* to the distribution terminal blocks 102*b*-102*f*. By the cross connection link combs 12, each time the potential is distributed across a conductor, such as a bus bar in the housing 3, to at least one row of second conductor connection arrangements 8. For example and advantageously, six output conductor connection arrangements 8 are provided here for each distribution board terminal block 2*b*-2*f*. In this way, a potential is distributed to many tapping points in a narrow space, whereby each of the modular terminal blocks of the terminal block assembly 101, including the feed-in terminal block 102*a*, is used also or only as an output terminal block and a distribution board terminal block. Here, again, the number of distribution board terminal blocks in the row is merely an example. There could easily be 100 or even more outputs provided.

In regard to the function of a power supply distribution which is realized, it should be noted that the potential is fed in at the feed-in terminal 102*a* (feed-in terminal 2*a*), the cross section is then reduced inside the feed-in and distribution board terminal 102*a*, and it is then relayed in another segment of the feed-in terminal or in another distribution board terminal to conductor connection apparatuses of smaller cross section.

The Plus potential (+24 volts) can be distributed in one such terminal block assembly 101, the Minus potential in another terminal block assembly (optionally of different color or provided with push buttons of different color in the activation openings 10), which in turn can optionally be grounded with a contact foot on the support rail.

While in accordance with the provisions of the Patent Statutes the preferred forms and embodiments of the invention have been illustrated and described, it will be apparent to those skilled in the art that changes may be made without deviating from the invention described above.

What is claimed is:

1. A terminal block assembly, comprising:

(a) a plurality of terminal blocks mounted in side-by-side relation on a common fixed support:

(1) each of said terminal blocks having a rectangular housing containing electrical circuitry and including a pair of parallel side walls, a top wall, and a pair of end walls;

(2) at least one of said terminal blocks comprising a supply terminal block adapted for connection with a voltage source;

(3) each of the remaining terminal blocks comprising a distribution terminal block adapted for connection with a load; and (4) at least one electrically-conducting link comb extending transversely across said terminal blocks to interconnect the electrical circuits contained therein;

(b) each of said terminal blocks having the same dimensions in directions orthogonally arranged relative to an axis defined by the support member;

(c) said supply terminal block having supply contact connections having a first cross-sectional area designed for connection with supply conductors having a relatively large cross-sectional area;

(d) said distribution terminal blocks having distribution contact connections having a second cross-sectional area less than said first cross-sectional area designed for connection with distribution conductors having a relatively small cross-sectional area.

2. A terminal block assembly as defined in claim 1, wherein each of said terminal block housings includes on its lower portion a foot arrangement for removably mounting said housing on said fixed support.

3. A terminal block assembly as defined in claim 2, wherein each of said supply and distribution contact connections comprises a resilient electrical contact arranged beneath a housing opening contained in said housing top wall, and an actuation arrangement for opening said contact to receive a conductor that is inserted into said opening and is clamped to said housing upon release of said contact.

4. A terminal block assembly as defined in claim 1, and further including at least one bus bar arranged within said housing and connected with said resilient contact, thereby to connect the conductor with electrical circuitry contained in said housing.

5. A terminal block assembly as defined in claim 4, and further including:

(e) a cross-link conductive comb member extending transversely across said terminal blocks for electrically connecting the electrical circuitry contained in selected ones of said terminal blocks.

6. A terminal block assembly as defined in claim 1, wherein at least some of said housing end walls contains deformations for receiving indicia-bearing markers.

7. A terminal block assembly as defined in claim 6, wherein one of said deformations is adjacent one corner between said housing top and side walls.

8. A terminal block assembly as defined in claim 1, wherein one of said terminal blocks comprises a supply terminal block having a greater width than that of each of said distribution terminal blocks.

9. A terminal block assembly as defined in claim 1, wherein said supply terminal block also includes distribution contact connections designed for connection with distribution conductors having a relatively small cross-sectional area.

10. A terminal block assembly as defined in claim 9, and further including a comb member for connecting a supply contact of said supply terminal block with corresponding contacts of each of said distribution terminal blocks.

11. A terminal block assembly as defined in claim 10, wherein said supply terminal block supply contact is connected with ground.

12. A terminal block assembly as defined in claim 1, wherein the cross-sectional area of the supply conductor is from about 0.5 $mm^2$ to about 6 $mm^2$, and the cross-sectional area of the distribution conductor is from about 0.5 $mm^2$ to about 2.6 $mm^2$.

13. A terminal block assembly, comprising:

(a) a plurality of terminal blocks mounted in side-by-side relation on a common fixed support:

(1) each of said terminal blocks having a rectangular housing containing electrical circuitry and including a pair of parallel side walls, a top wall, and a pair of end walls;

(2) at least one of said terminal blocks comprising a supply terminal block adapted for connection with a voltage source, a top wall of said supply terminal block containing a first conductor opening adjacent a first corner of said supply terminal block housing, and a second conductor opening spaced from said first corner about 60% to 90% of the distance of the length of said supply terminal block housing;

(3) each of the remaining terminal blocks comprising a distribution terminal block adapted for connection with a load, said supply terminal block having a greater width than said distribution terminal blocks; and (4) at least one electrically-conducting link comb extending transversely across said terminal blocks to interconnect the electrical circuits contained therein;

(b) each of said terminal blocks having the same dimensions in directions orthogonally arranged relative to the axis defined by the support member;

(c) said supply terminal block having supply contact connections designed for connection with supply conductors having a relatively large cross-sectional area;

(d) said distribution terminal blocks having distribution contact connections designed for connection with distribution conductors having a relatively small cross-sectional area.

14. A terminal block assembly as defined in claim 13, wherein a top portion of said terminal block assembly contains a plurality of cross-connecting grooves that extend transversely across the top portions of all of said terminal blocks.

15. A terminal block assembly as defined in claim 14, and further including a plurality of conductive comb members arranged in said cross-connecting grooves for electrically connecting together the contacts of electrical circuitry contained in said terminal block housings, respectively.

16. A terminal block assembly as defined in claim 15, wherein said distribution terminal blocks include two parallel spaced rows of output contacts connected with the electrical circuitry of said distribution terminal blocks, respectively, said outlet contacts being connected with load conductors having relatively smaller cross-sectional areas via corresponding outlet conductor openings contained in the housing top walls.

17. A terminal block assembly as defined in claim 16, wherein a first row of said outlet contacts is connected with a first voltage source via a first transverse conductive comb member, and a second row of said outlet contacts is connected with a second voltage source via a second transverse conductive comb member.

18. A terminal block assembly as defined in claim 17, wherein said terminal block assembly includes a plurality of fuse devices mounted on said distribution terminal block housing top walls, respectively, each of said fuse devices being connected in the electrical circuitry between said second comb member and said second row of output contacts, respectively.

19. A terminal block assembly as defined in claim 17, wherein said first row of outlet contacts is connected with ground via said support member.

* * * * *